United States Patent [19]

Cuneo et al.

[11] 3,978,808

[45] Sept. 7, 1976

[54] DOUBLE WALL CARGO TANK FOR TRANSPORTING CRYOGENICS

[75] Inventors: Joseph J. Cuneo, Scarsdale, N.Y.; Ivan Mertl, Greenwich, Conn.

[73] Assignee: John J. McMullen Associates, Inc., New York, N.Y.

[22] Filed: Sept. 11, 1973

[21] Appl. No.: 396,302

[52] U.S. Cl. ..... 114/74 A; 62/55; 220/9 LG

[51] Int. Cl.[2] ..... B63B 25/16

[58] Field of Search..... 14/74 R, 74 A; 220/9 A, 220/9 LG, 15; 62/45, 55

[56] References Cited

UNITED STATES PATENTS

| | | | |
|---|---|---|---|
| 3,312,076 | 4/1967 | Clarke et al. | 62/55 |
| 3,319,431 | 5/1967 | Clarke et al. | 114/74 A |
| 3,811,593 | 5/1974 | Bridges et al. | 114/74 A |

FOREIGN PATENTS OR APPLICATIONS

| | | | |
|---|---|---|---|
| 284,266 | 1/1928 | United Kingdom | 114/74 A |
| 860,819 | 2/1961 | United Kingdom | 114/74 A |

*Primary Examiner*—Trygve M. Blix
*Assistant Examiner*—Charles E. Frankfort
*Attorney, Agent, or Firm*—Fleit & Jacobson

[57] ABSTRACT

A double wall tank for the transportation of cryogenic materials such as liquefied natural gas by ship. The inner wall of the tank is the primary barrier and defines the cargo space. The primary barrier is substantially planar and is liquid and gas-impervious. A plurality of primary structural support webs are welded to the inner surface of the primary barrier and extend into the cargo space. The primary structural support webs preferably comprise a plurality of web rings extending between the centerline longitudinal bulkhead and the sides of the inner tank and having plurality of tension trusses extending transversely in the inner tank and connecting opposite sides of the web rings. A plurality of stiffeners are welded to the outer surface of the primary barrier and extend substantially perpendicular to the plane of the primary structural support webs. The outer wall of the tank is the secondary barrier, is spaced from the primary barrier and is supported by the stiffeners. The secondary barrier is formed from thin sheets of metal, is non-self-supporting and is liquid and gas-impervious. Insulation, preferably in the form of a plurality of insulation panels, is located outside of the secondary barrier for thermally insulating the tank.

20 Claims, 17 Drawing Figures

Fig. 1.
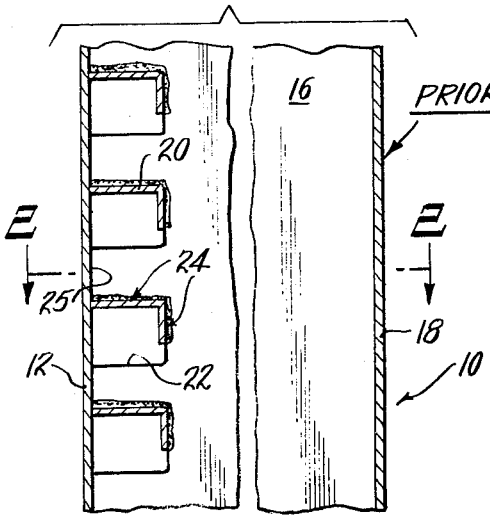
Fig. 2.
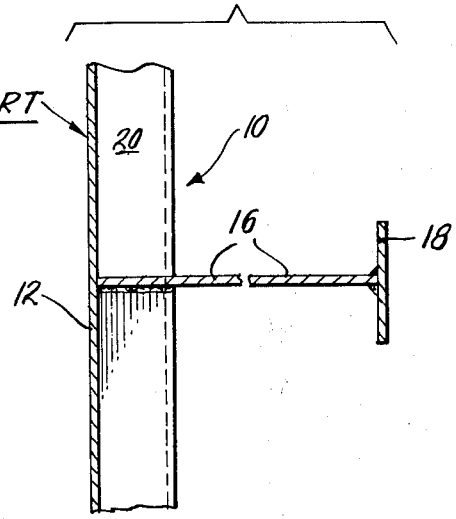
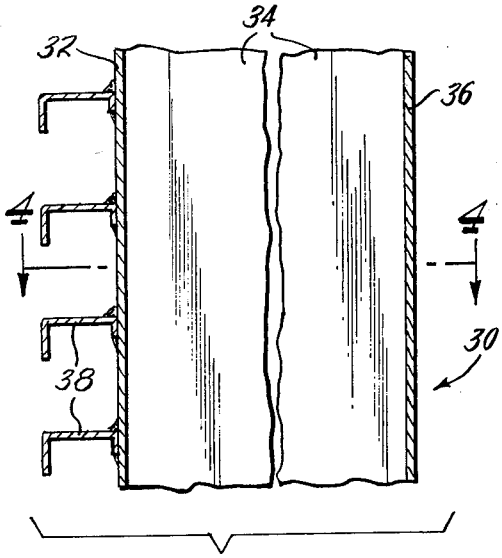
Fig. 3.
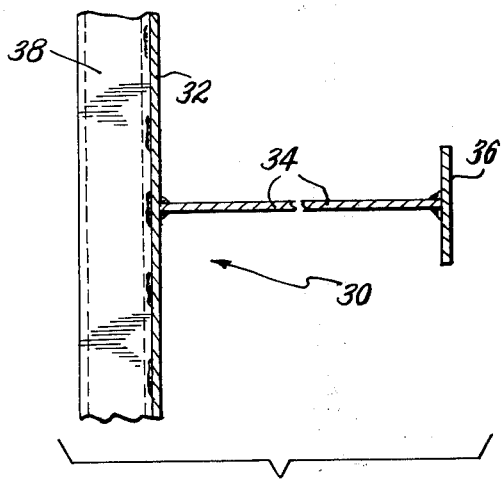
Fig. 4.

Fig. 11.
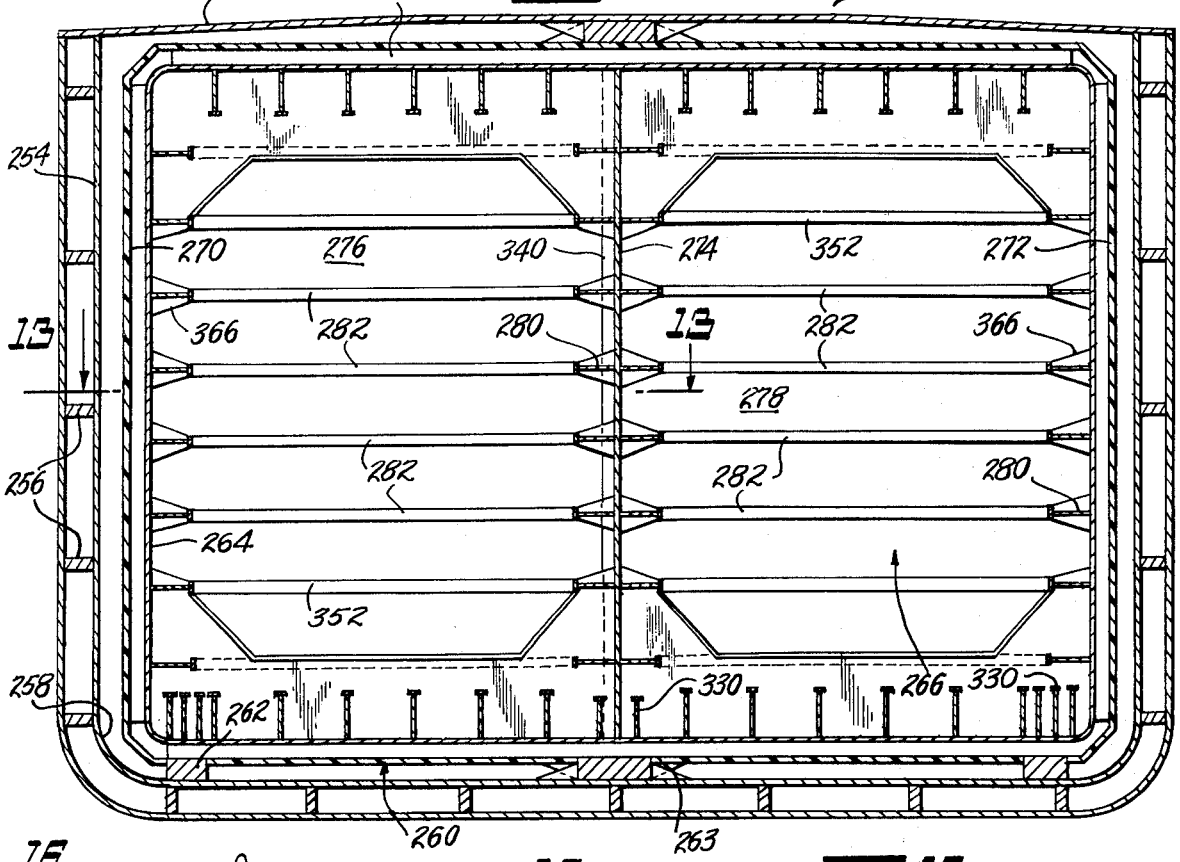
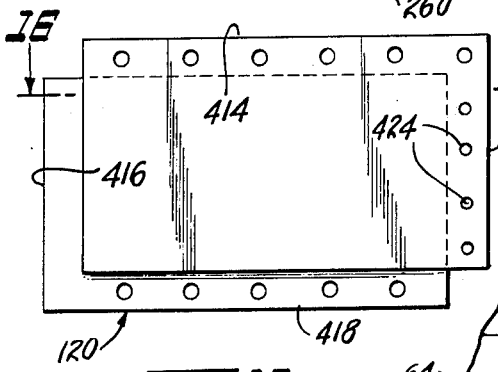
Fig. 15.
Fig. 17.
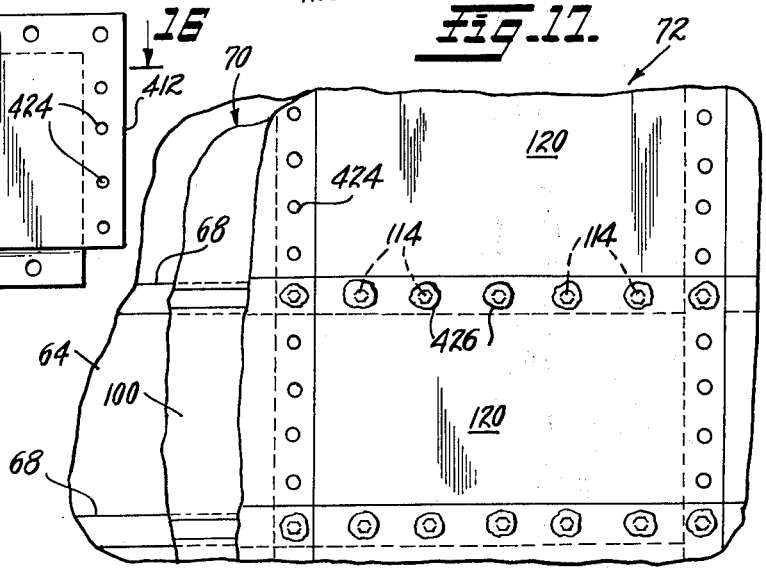
Fig. 16.
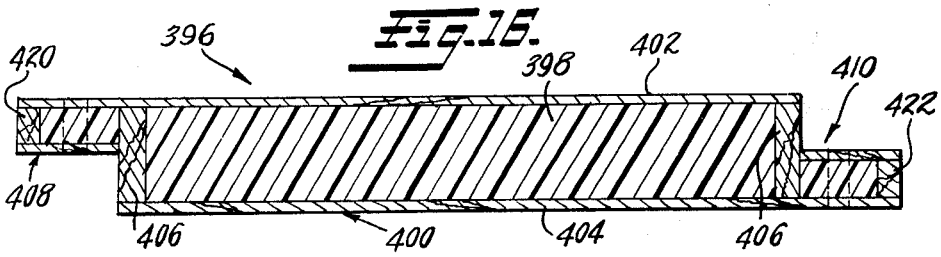

DOUBLE WALL CARGO TANK FOR TRANSPORTING CRYOGENICS

BACKGROUND OF THE INVENTION

The present invention relates to a novel tank construction for carrying a cryogenic fluid such as liquefied natural gas at about ambient pressure, and more particularly, to a double wall cargo tank of this type.

In the transportation of cryogenic fluids such as liquefied natural gas, various tank configurations have been designed including free-standing flat and corrugated plate tanks, and single and double wall tanks. These tanks are typically supported either above or upon a bed of thermal insulation within the hull of the transport ship.

The flat plate design requires either that the insulation space between the tank walls and the ship structure be completely filled with load bearing insulation or alternately that a plurality of stiffening members be welded to the tank walls so that adequate strength is provided. These stiffeners conventionally lie inside the primary barrier of the tank, pass through openings formed in the internal structural support webs of the tank, and are welded to the primary barrier and to the internal structural support webs. Tank construction of this nature is very difficult and manual welding is required which increases the cost and the time of construction of the tank. Accordingly, it would be desirable to provide a means of stiffening the tank walls which would avoid the tedious and costly manual welding typically associated with conventionanl stiffeners.

Accordingly, it is a broad object of the present invention to provide a new and improved double wall tank design in which the stiffeners are arranged so as to enable automatic welding techniques to be employed.

It is a further object of the present invention to provide a double wall tank design in which the secondary barrier is supported by the stiffeners.

It is another object of the present invention to provide a double wall tank design in which the stiffeners form a part of the liquid and gas-impervious secondary barrier.

It is still another object of the present invention to provide a double wall tank design in which means are provided for transferring part of the load normally carried by the sides of the tank to the tank's centerline longitudinal bulkhead.

It is yet another object of the present invention to provide a double wall tank design in which the weight of the primary structural support web system is reduced.

Still another object of the present invention is to provide a double wall tank design in which the insulation means acts as a support for the liquid and gas-impervious secondary barrier.

Still a further object of the present invention is to provide a double wall tank design in which the insulation means located outside the secondary barrier is formed by a plurality of insulating panels which are easily assembled and disassembled.

These and other objects of the present invention, as well as many of the attendant advantages thereof, will become more readily apparent when reference is made to the following description taken in conjunction with the accompanying drawings

SUMMARY OF THE INVENTION

The present invention relates to a double wall tank for the transportation of cryogenic materials by ship. The double wall tank generally comprises a liquid and gas-impervious inner tank which is free-standing and self-supporting and defines the cargo space. The inner tank is of substantially flat plate construction and is the primary barrier of the double wall tank. A plurality of internal primary structural support webs are welded to the inner surface of the primary barrier and extend into the cargo space. A plurality of stiffeners are welded to the outer surface of the primary barrier and extend substantially perpendicular to the plane of the adjacent primary structural support webs. According to one embodiment of the invention, the stiffeners are bulb angles. According to another embodiment of the invention, the stiffeners take the form of I-beams.

The outer tank, which forms the secondary barrier of the double wall tank, is spaced from the inner tank and is supported by the stiffeners. The secondary barrier is formed from a plurality of thin metal sheets attached to the outer face of the stiffeners so that the secondary barrier is liquid and gas-impervious. With this arrangement, the outer face of the stiffeners forms part of the secondary barrier. Thermal insulation means is located outside the secondary barrier and spaced from the hull of the transport ship. The insulation means preferably comprises a plurality of insulation panels attached to the stiffeners. The insulation panels are arranged in end-to-end and side-by-side relationship and have lap joints therebetween.

A centerline longitudinal bulkhead is located inside the inner tank and divides the inner tank into port and starboard cargo areas. A plurality of primary structural support web rings extend between the centerline longitudinal bulkhead and the sides of the inner tank and are welded thereto. According to the preferred aspects of the invention, a plurality of tension trusses extend transversely in the inner tank and connect opposite sides of the web rings. Because of the hydrostatic forces, the side walls of the cargo tank are normally in tension relative to the centerline longitudinal bulkhead. The tension trusses serve to transfer part of the load normally carried by the outboard side walls of the double wall tank to the centerline longitudinal bulkhead. These tension trusses are typically T-beams welded to the face plates which extend around the inner periphery of the web rings. Trapezoidal-shaped brackets connect the face plates of the web rings to the primary barrier at the points of connection of the tension trusses in order to better transfer the load from the outboard sides of the cargo tank to the centerline longitudinal bulkhead.

In accordance with one embodiment of the invention, the web rings are vertical and extend transversely in the cargo tank. This vertical web ring arrangement enables the efficient transfer of the load to the bottom of the cargo tank. The use of vertical web rings, however, presents the disadvantage that under partial loading conditions, thermal deformation creates additional stresses in these vertical webs. This results since the bottom of the tank is relatively colder than the top of the tank because of the presence of the liquid cryogenic cargo. Accordingly, in accordance with a second embodiment of the present invention, the web rings are arranged horizontally in the tank. With this arrangement, the thermal deformation is reduced since all of the sides of a particular web ring are at substantially the same temperature.

BRIEF DESCRIPTION OF THE DRAWINGS

FIG. 1 is a vertical cross-section showing a typical means for stiffening the primary barrier of a prior art double wall cargo tank.

FIG. 2 is a horizontal cross-section taken along lines 2—2 of FIG. 1.

FIG. 3 is a vertical cross-section similar to FIG. 1 but illustrating the stiffening means of the double wall cargo tank of the present invention.

FIG. 4 is a horizontal cross-section taken along lines 4—4 of FIG. 3.

FIG. 11 is a vertical transverse section of a ship containing a cargo tank in accordance with a second embodiment of the present invention.

FIG. 15 is a plan view of a typical thermal insulation panel employed in accordance with the present invention.

FIG. 16 is a cross-section taken through the insulation panel of FIG. 15 along lines 16—16.

FIG. 17 is a side view of the cargo tank of the present invention illustrating the outer wall of the secondary barrier with the insulation panels in place.

DETAILED DESCRIPTION OF THE DRAWINGS

Figure 5:
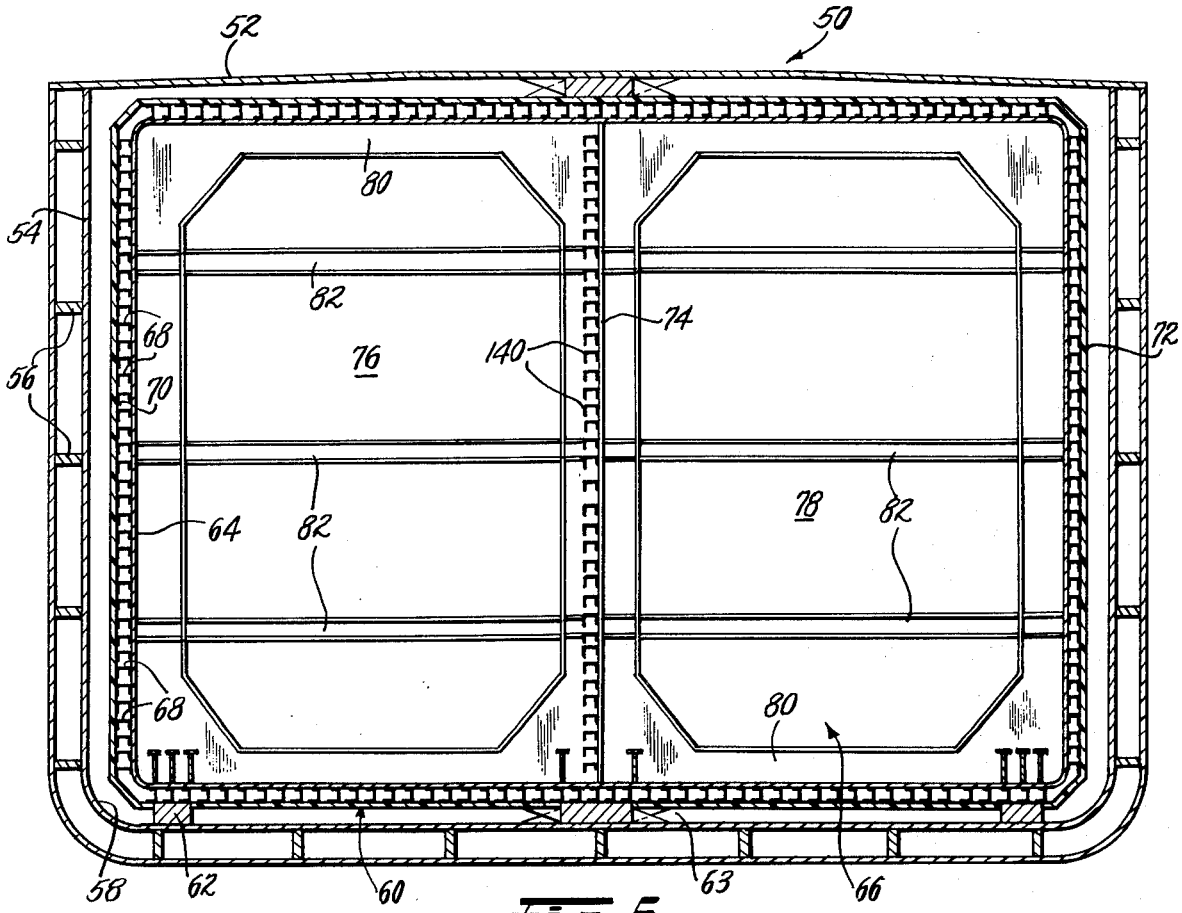
FIG. 5 is a vertical transverse section of a ship containing a cargo tank in accordance with one embodiment of the present invention.

With reference first to FIGS. 1 and 2, typical means for stiffening the primary barrier of the prior art double wall cargo tank will be described. The cargo area is shown generally at 10 and is defined by a substantially flat plate primary barrier 12. The secondary barrier and thermal insulation are not shown in these figures. Primary barrier 12 is strengthened by a number of internal webs 16, each having a stiffening face plate 18. A plurality of internal stiffeners 20 extend perpendicular to the plane of internal webs 16 and pass through cutouts 22 formed in internal webs 16. Stiffeners 20 lie on the inner or cargo side of primary barrier 12 and in combination with the internal web 16 function to stiffen primary barrier 12. This arrangement of stiffeners 20 has certain advantages including the large contact area, shown generally at 24, between stiffeners 20 and internal webs 16. This arrangement also suffers from several disadvantages, however, including the complicated and costly welding procedures required to attach stiffeners 20 to primary barrier 12 and to internal webs 16. These complicated welding procedures include the use of hand welding, particularly in those areas 24 and 25 where stiffeners 20 must be welded to internal webs 16 and primary barrier 12, respectively.

With reference now to FIGS. 3 and 4, the basic construction of the stiffener portion of the cargo tank forming the present invention will be described. The cargo area is indicated generally at 30 and is defined by a substantially flat plate primary barrier 32. The secondary barrier and thermal insulation are not shown in these figures. Primary barrier 32 is strengthened by a number of internal webs 34, each having a stiffening face plate 36. A plurality of external stiffeners 38 extend perpendicular to the plane of internal webs 34. Contrary to the typical prior art arrangement, however, stiffeners 38 are external to primary barrier 32 and lie on the outer or hull side thereof. As in the typical prior art arrangement, stiffeners 38 and internal webs 34 function to stiffen primary barrier 32. Stiffeners 38 also function to support the secondary barrier and thermal insulation as will be described subsequently. Placing stiffeners 38 exterior to primary barrier 32 results in several advantages over the typical prior art arrangement. As can easily be seen, all of the welding operations required to attach stiffeners 38 to primary barrier 32 can be accomplished from outside cargo area 30. Furthermore, and most importantly, only straight line welding procedures are required to attach internal webs 34 to primary barrier 32. For these reasons, most if not all of the hand welding commonly required in accordance with the typical prior art arrangement can be eliminated. Accordingly, the overall fabrication costs of the cargo tank are greatly reduced.

Referring now to FIG. 5, a view is seen of one embodiment of the inventive double wall cargo tank of the present invention installed in a liquefied natural gas transport ship. Ship 50 comprises outer hull 52 and inner hull 54 attached together by structural support members 56. Inner hull 54 defines cargo hold 58. The cargo tank, shown generally at 60, is supported within cargo hold 58 and spaced from inner hull 54 by a plurality of wood bearing blocks 62 and keys 63. Wood bearing blocks 62 and keys 63 also function to permit thermal expansion and contraction of tank 60 while maintaining the proper alignment of tank 60 relative to ship 50.

Cargo tank 60 is prismatic in shape and comprises inner tank or primary barrier 64 and outer tank or secondary barrier 70. Primary barrier 64 has the general shape of cargo hold 58 and is a free-standing, self-supporting tank of substantially flat plate construction. That is, the sides, top and bottom of inner tank 64 are planar except at their sides and ends where they are curved to provide a smooth transition between adjacent tank walls. Primary barrier 64 is formed from metal such as nickel steel or aluminum alloy which is capable of withstanding the thermal and mechanical stresses associated with a cryogenic cargo. Primary barrier 64 is liquid and gas-tight and defines a cargo area 66.

Exterior to primary barrier 64 and attached thereto are a plurality of stiffeners 68. Stiffeners 68 serve to provide structural rigidity to primary barrier 64 and to support secondary barrier 70. Stiffeners 68 are made of metal similar to that used in primary barrier 64 in order to minimize temperature differences between primary barrier 64 and secondary barrier 70.

Secondary barrier 70 has the general shape of cargo hold 58 and surrounds and is spaced from primary barrier 64. Secondary barrier 70 is attached to stiffeners 68. Secondary barrier 70 is non-self-supporting and is formed from thin sheets of metal (e.g., 0.02 inch) such as stainless steel which is capable of withstanding the thermal gradients associated with a cryogenic cargo. Secondary barrier 70 is liquid and gas-impervious.

Surrounding secondary barrier 70 and spaced from inner hull 54 is a layer of thermal insulation 72. As is conventional in the art, sufficient thermal insulation 72 is applied to the exterior of secondary barrier 70 to prevent the volatilization of the cryogenic cargo. By this arrangement, primary barrier 64, stiffeners 68 and secondary barrier 70 will be at substantially the same temperature, yet inner and outer hulls 54 and 52, respectively, of tanker 50 will be insulated from the cryogenic cargo.

Cargo tank 60 is divided longitudinally by centerline longitudinal bulkhead 74. Longitudinal bulkhead 74 is liquid impervious and divides cargo area 66 into port and starboard cargo areas 76 and 78, respectively. Vapor pressure equalization means (not shown) are provided between port and starboard cargo areas 76 and 78. Two of a plurality of vertical webs 80 running transversely within tank 50 are seen in FIG. 5. The longitudinal axis of stiffeners 68 which are adjacent to vertical webs 80 are perpendicular to the plane of vertical webs 80. Each of vertical webs 80 has a plurality of transverse tension trusses 82 which help to transfer loads normally carried by the outboard sides of cargo tank 60 to centerline longitudinal bulkhead 74.

Figure 6:
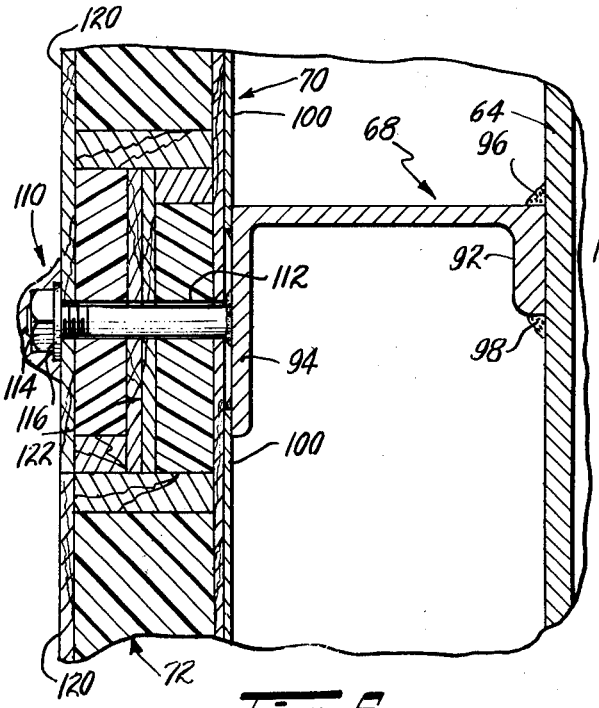
FIG. 6 is a vertical cross-section showing a fragmentary view of the side wall of the cargo tank illustrated in FIG. 5 and showing the stiffening means of the present invention.

Turning now to FIG. 6, an enlarged view is shown of the sidewall of cargo tank 60. As seen in FIG. 6, stiffener 68 is exterior to primary barrier 64 and is a bulb angle. Stiffener 68 comprises web portion 90, primary flange portion 92 and secondary flange portion 94. Primary flange portion 92 is welded to primary barrier 64. Only machine welding is required to attach stiffener 68 to primary barrier 64. This is illustrated in the figure by fillet welds 96 and 98 at the top and bottom periphery of primary flange portion 92. Primary flange portion 92 is provided on stiffener 68 in order to avoid stress concentrations which would result from the "point" contact between the inner end of web portion 90 of stiffener 68 and primary barrier 64. The inner face of primary flange portion 92 provides a relatively large contact area between stiffener 68 and primary barrier 64 and acts to distribute the load more evenly. Web portion 90 of stiffener 68 lies in a plane which is perpendicular to the plane of primary barrier 64. The web portions 90 of the stiffeners 68 which are attached to the sides and ends of inner tank 64 are horizontal, and the web portions 90 of the stiffeners 68 which are attached to the top and bottom of inner tank 64 are vertical.

Figure 7:
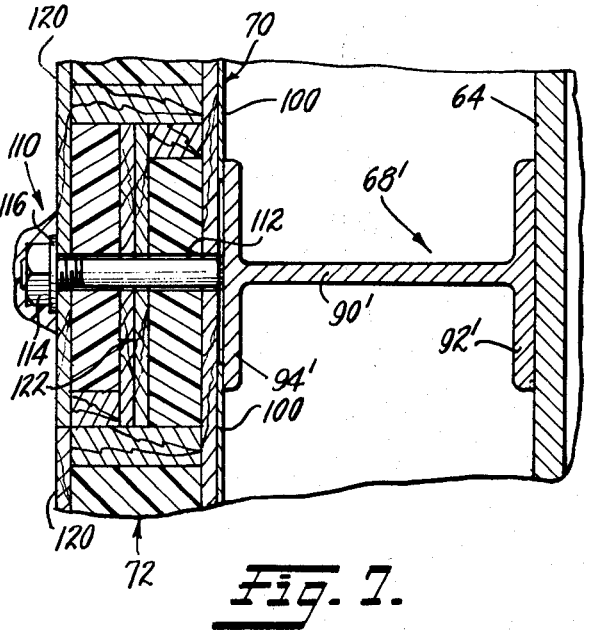
FIG. 7 is similar to FIG. 6 but illustrates an alternate embodiment of the stiffening means of the present invention.

Even better distribution of the load is provided by the I-beam stiffener 68' illustrated in FIG. 7 and which represents an alternate embodiment of the external stiffeners of the present invention. Like stiffener 68, stiffener 68' has web portion 90', primary flange portion 92' and secondary flange portion 94'. Primary flange portion 92' provides even a larger contact area between stiffener 68' and primary barrier 64 than does primary flange portion 92. Accordingly, potential force concentrations are prevented from building up and the load more uniformly distributed. Secondary flange portion 94' of stiffener 68' has the same general shape as secondary flange portion 94 of stiffener 68.

The secondary barrier 70 is formed from a plurality of thin metal sheets. The relative thickness of metal sheets 100 is greatly enlarged in the figures for the purposes of illustration. Metal sheets 100 extend in the same direction as stiffeners 68 and have their sides attached to adjacent stiffeners 68. As seen in FIG. 6, the bottom side of upper metal sheet 100 of secondary barrier 70 is welded to the outer face of secondary flange portion 94 of stiffener 68 near the top outer face of stiffener 68. In like manner, the top side of lower metal sheet 100 of secondary barrier 70 is welded to the outer face of secondary flange portion 94 near the bottom outer face of stiffener 68. In accordance with this arrangement, therefore, secondary flange portion 94 of stiffener 68 forms part of secondary barrier 70. Furthermore, the spacing between the sides of metal sheets 100 of secondary barrier 70 allows space for attaching thermal insulation 72 to secondary flange portion 94 of stiffener 68. The ends of metal sheets 100 are attached to stiffeners (not shown) at the corners of cargo tank 60.

Thermal insulation 72 comprises a plurality of insulation panels 120 arranged in side-by-side and end-to-end relationship to cover the entire outer surface of secondary barrier 70. Insulation panels 120 have edge portions which overlap to form a lap joint 122. Insulation panels 120 are attached to secondary barrier 70 by attachment means 110 which comprises stud bolt 112 extending through the edge portions of insulation panels 120 and welded to the outside face of secondary flange portion 94. Attachment means 110 further comprises nut 114 attached to the threaded end of stud bolt 112 and washer 116 lying between and abutting against nut 114 and the edge portions of insulation panels 120. By this arrangement, insulation panels 120 provide a backing and support for thin metal sheets 100.

Figure 8:
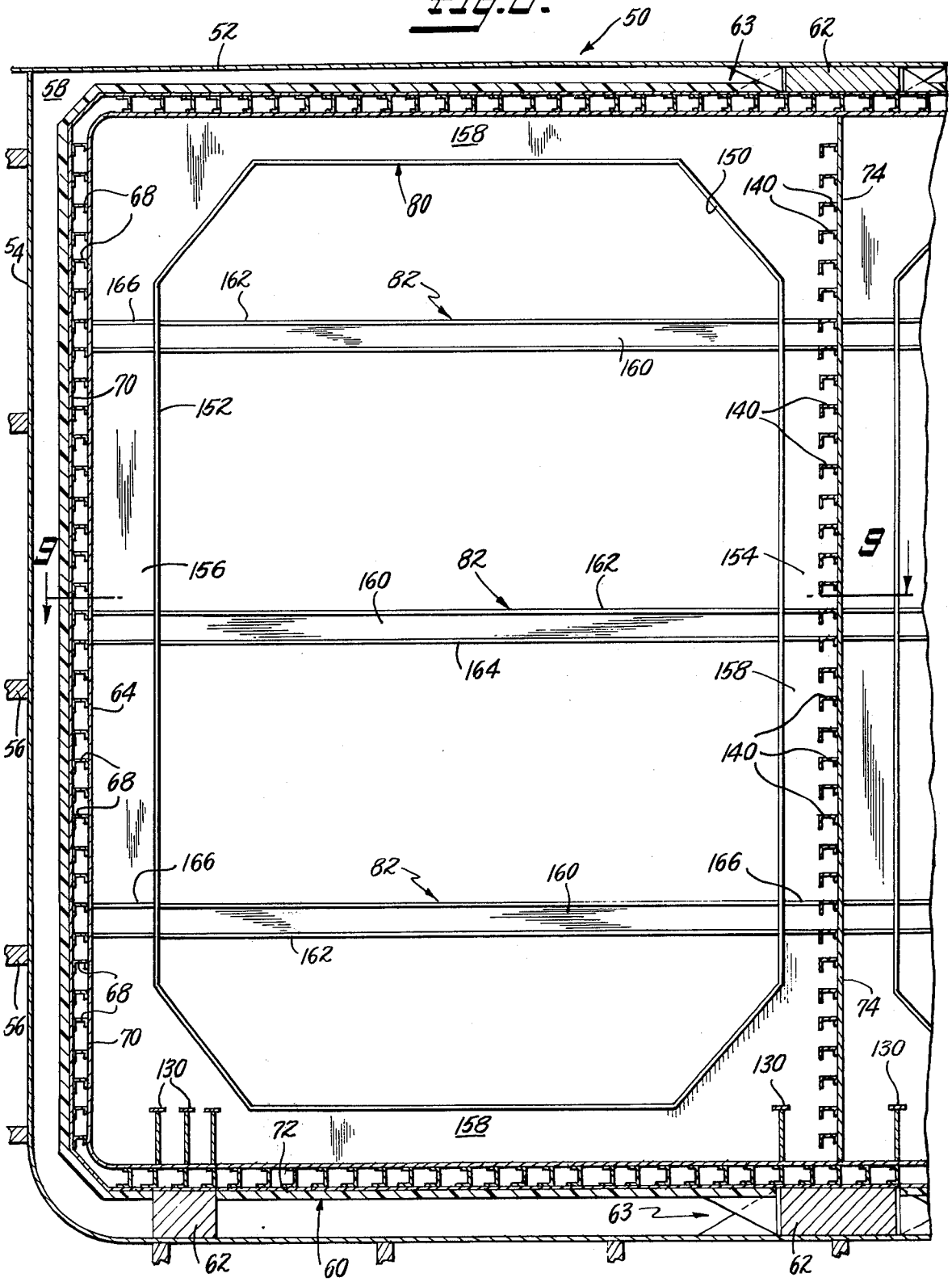
FIG. 8 is an enlarged view of the part side of the cargo tank illustrated in FIG. 5.

Referring now to FIG. 8, the wood bearing blocks 62 seen in the figure extend longitudinally within inner hull 54 of ship 50. Another wood bearing block 62 (not shown) extends transversely within inner hull 54 of ship 50 near the longitudinal center of cargo tank 60. One surface of each wood bearing block 62 contacts and bears against inner hull 54. The other surface of each wood bearing block 62 is flush with the outer surface of secondary barrier 70. The wood bearing block 62 which runs along the top of inner hull 54 and the associated keyways 63 may optionally be omitted. The use of this top block and keyway arrangement allows a reduction in the overall cargo tank 60 weight but necessitates an increase in the overall ship 50 weight. Directly above the wood bearing blocks 62 which run along the bottom of inner hull 54 are a plurality of T-shaped structural members 130 which extend longitudinally along the inner bottom of cargo tank 60. T-shaped members 130 are welded to the inner surface of primary barrier 64 and pass through vertical webs 80. T-shaped members 130 aid in transmitting the load through wood bearing blocks 62 to the bottom of ship 50. Cargo tank 60 is keyed to tanker 50 by means of a conventional key and keyway arrangement. Some of the keyways are shown at 63 and the wood bearing blocks 62 in the transverse and longitudinal centers of ship 50 form the keys. The key and keyway arrangement is preferably as described in U.S. Pat. No. 3,428,205, assigned to the present assignee and entitled ARRANGEMENT FOR MAINTAINING ALIGN-

MENT OF COLD TANKS WITHIN A SHIP OR THE LIKE.

As seen in FIG. 8, a plurality of stiffeners 140 are attached to one side of the centerline longitudinal bulkhead 74. These stiffeners pass through vertical webs 80 and serve to stiffen centerline longitudinal bulkhead 74 in conventional manner.

Vertical webs 80 are generally rectangular in outline. Each of vertical webs 80 are welded to centerline longitudinal bulkhead 74 and to the inner surface of inner tank 64. Vertical webs 80 have cutout portions 150 which form web rings 158. Each of vertical webs 80 has a stiffening face plate 152 which extends around the inner periphery of web rings 148. A plurality of transverse tension trusses 82 extend across cutout portion 150 of each web 80 and connect inner vertical side portion 154 to outer vertical side portion 156 of each web ring 158.

Transverse tension trusses 82 comprise I-beams having web portions 160 and upper and lower flange portions 162 and 164, respectively. The ends of transverse tension trusses 82 are welded to the inner face of face plates 152 of webs 80. Trapezoidal-shaped brackets 166 are welded to primary barrier 64, web rings 158 and the outer faces of face plates 152 on both sides of web 80 in the same horizontal plane as each flange portion 162 and 164 of transverse tension trusses 82. Because of the hydrostatic forces associated with the cryogenic cargo, the side walls of cargo tank 60 are normally in tension relatively to centerline longitudinal bulkhead 74. Accordingly, transverse tension trusses 82 are in tension, and serve to transfer part of the load normally carried by the side walls of cargo tank 60 to centerline longitudinal bulkhead 74. Furthermore, the use of transverse tension trusses 82 allows a reduction to be made in the scantling of vertical webs 80 thereby reducing the weight of these webs.

Figure 9:
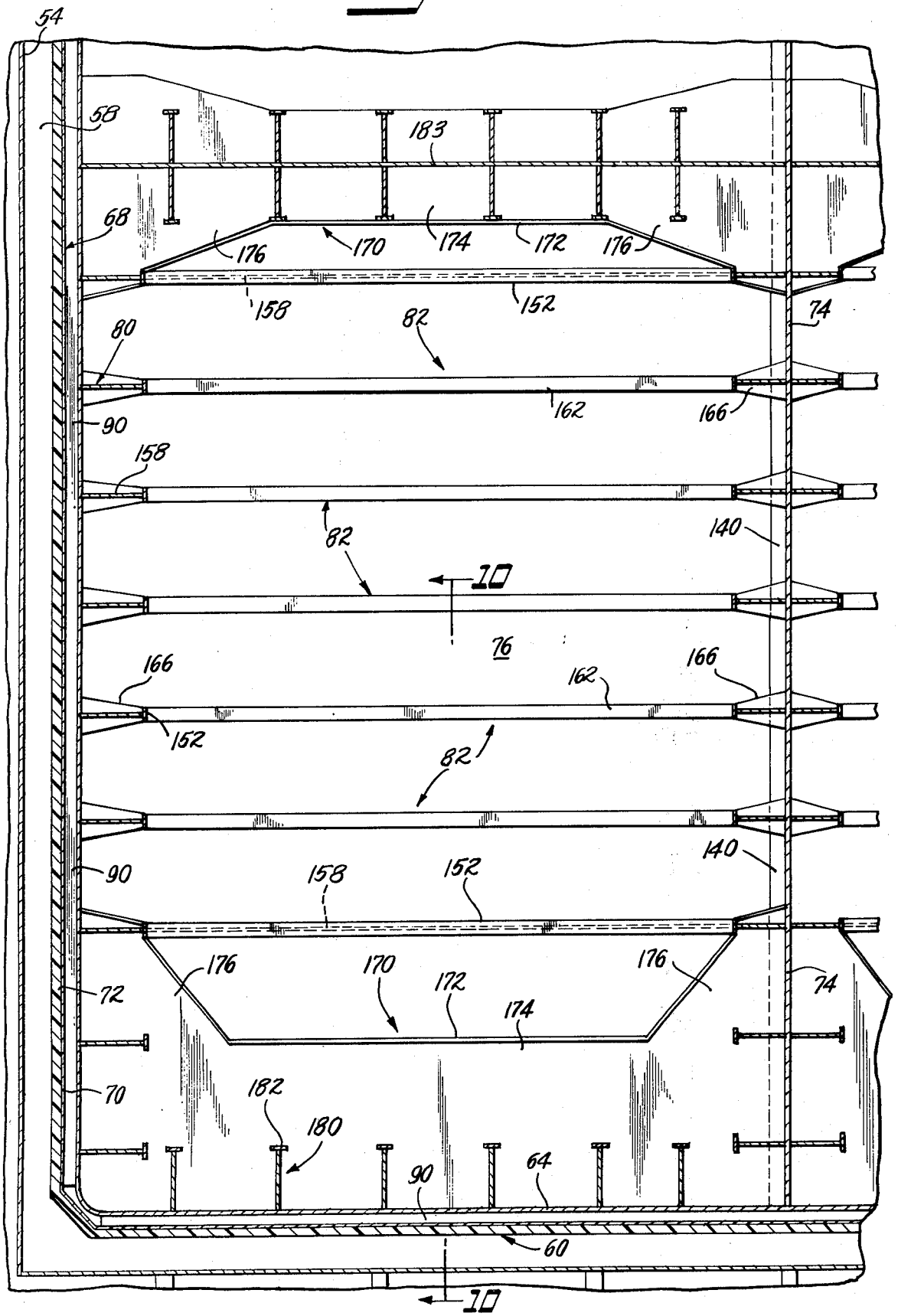
FIG. 9 is a horizontal cross-section taken along lines 9—9 of FIG. 8.
Figure 10:
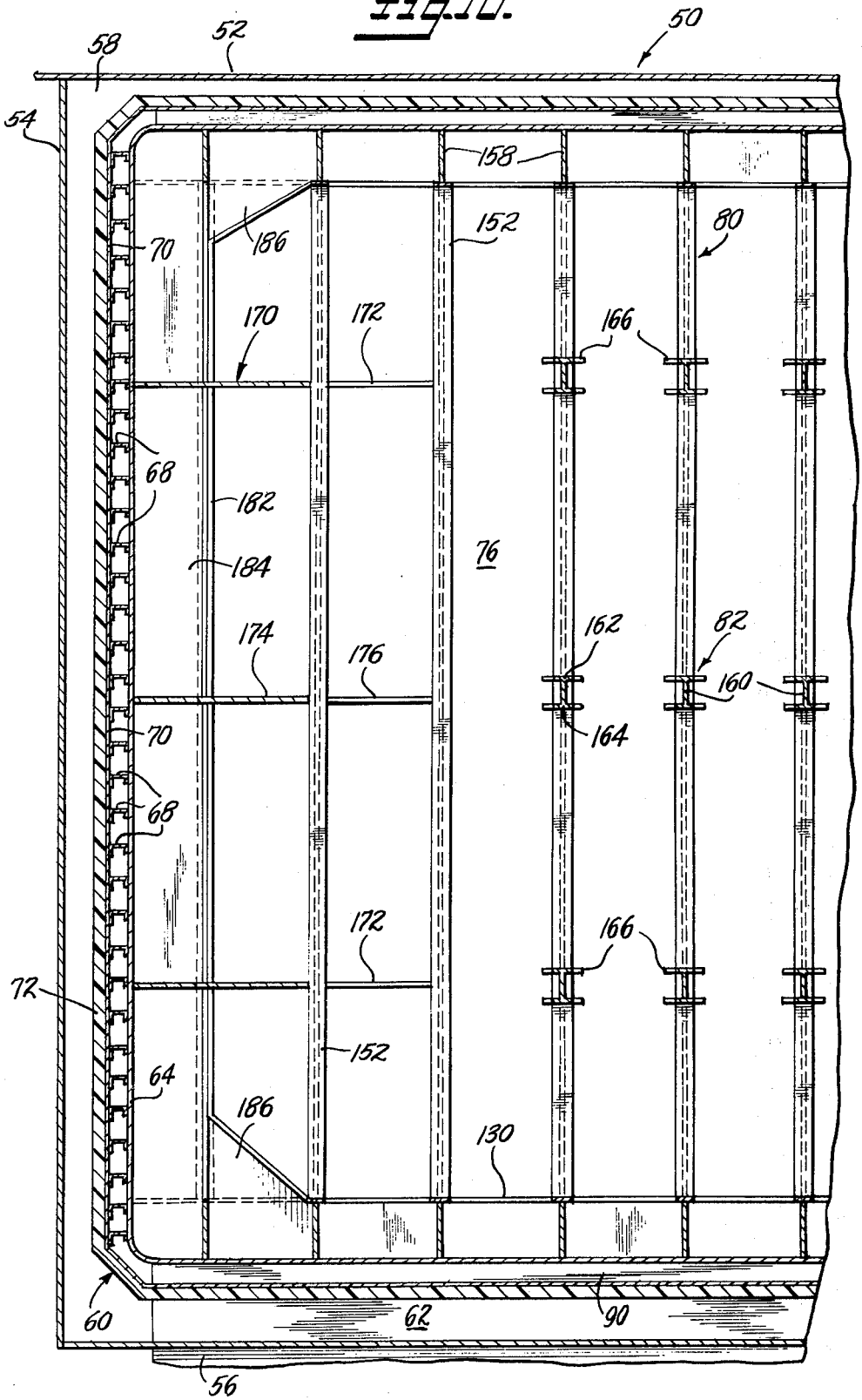
FIG. 10 is a vertical cross-section taken along line 10—10 of FIG. 9.

As best seen in FIGS. 9 and 10, cargo tank 60 also includes a plurality of vertical webs 180 having stiffening face plates 182 extending around the inner periphery thereof and which form a part of the primary structural support web system. Vertical webs 180 run longitudinally in cargo tank 60 and are welded to the inner surface of inner tank 64 at the longitudinal ends thereof and to the inner surface of inner tank 64 and to centerline transverse bulkhead 183 at the longitudinal center of cargo tank 60. Vertical webs 180 pass through horizontal webs 170. Vertical webs 180 are generally C-shaped and have main body portion 184 and leg portions 186 which are each welded at their ends to one of vertical webs 80.

A plurality of horizontal webs 170 having stiffening face plates 172 around the inner periphery thereof form a part of the secondary structural support web system (see FIGS. 9 and 10). Horizontal webs 170 are placed at the same vertical level as transverse tension trusses 82. There are two horizontal webs 170 in the horizontal plane of each of tension trusses 82 in each quadrant of cargo tank 60. One of these horizontal webs 170 is positioned at the longitudinal end of inner tank 64 and is welded to centerline longitudinal bulkhead 74 and the inner surface of primary barrier 64. The other of these horizontal webs 170 is positioned at the longitudinal center of inner tank 64 and is welded to centerline longitudinal bulkhead 74, centerline transverse bulkhead 183 and the inner surface of primary barrier 64. As can be seen in the figures, the three vertical webs 80 at the longitudinal end of cargo tank 60 do not have transverse tension trusses 82, but rather pass through horizontal webs 170. Horizontal webs 170 are generally C-shaped and have main body portion 174 and leg portions 176 which are each welded at their ends to one of vertical webs 80.

Referring now to FIG. 11, a view is seen of a second embodiment of the double wall cargo tank of the present invention installed in a liquefied natural gas transport ship. Ship 250 comprises outer hull 252 and inner hull 254 attached together by structural support members 265. Inner hull 254 define cargo area 258. The cargo tank, shown generally at 260, is supported within cargo hold 258 by a plurality of wood bearing blocks 262 and keys 263. As with respect to the first embodiment, the wood bearing block 262 which runs along the top of inner hull 254 and the associated keyway 263 may optionally be omitted. Directly above wood bearing blocks 262 are a plurality of T-shaped structural members 330 which extend longitudinally along the inner bottom of cargo tank 260. Cargo tank 260 comprises inner tank or primary barrier 264 and outer tank or secondary barrier 270. Primary barrier 264 defines cargo area 266. Exterior to primary barrier 264 and attached thereto are a plurality of stiffeners 268. Secondary barrier 270 is spaced from primary barrier 264 and is attached to stiffeners 268. Thermal insulation 270 is formed from a plurality of insulation panels attached to stiffeners 268 and spaced from inner hull 254. This portion of the second embodiment of the double wall cargo tank of the present invention is generally the same as the corresponding portion of the first embodiment, and the means of attaching secondary barrier 270 and thermal insulation 272 stiffeners 268 is the same as illustrated in FIG. 6.

Figure 12:
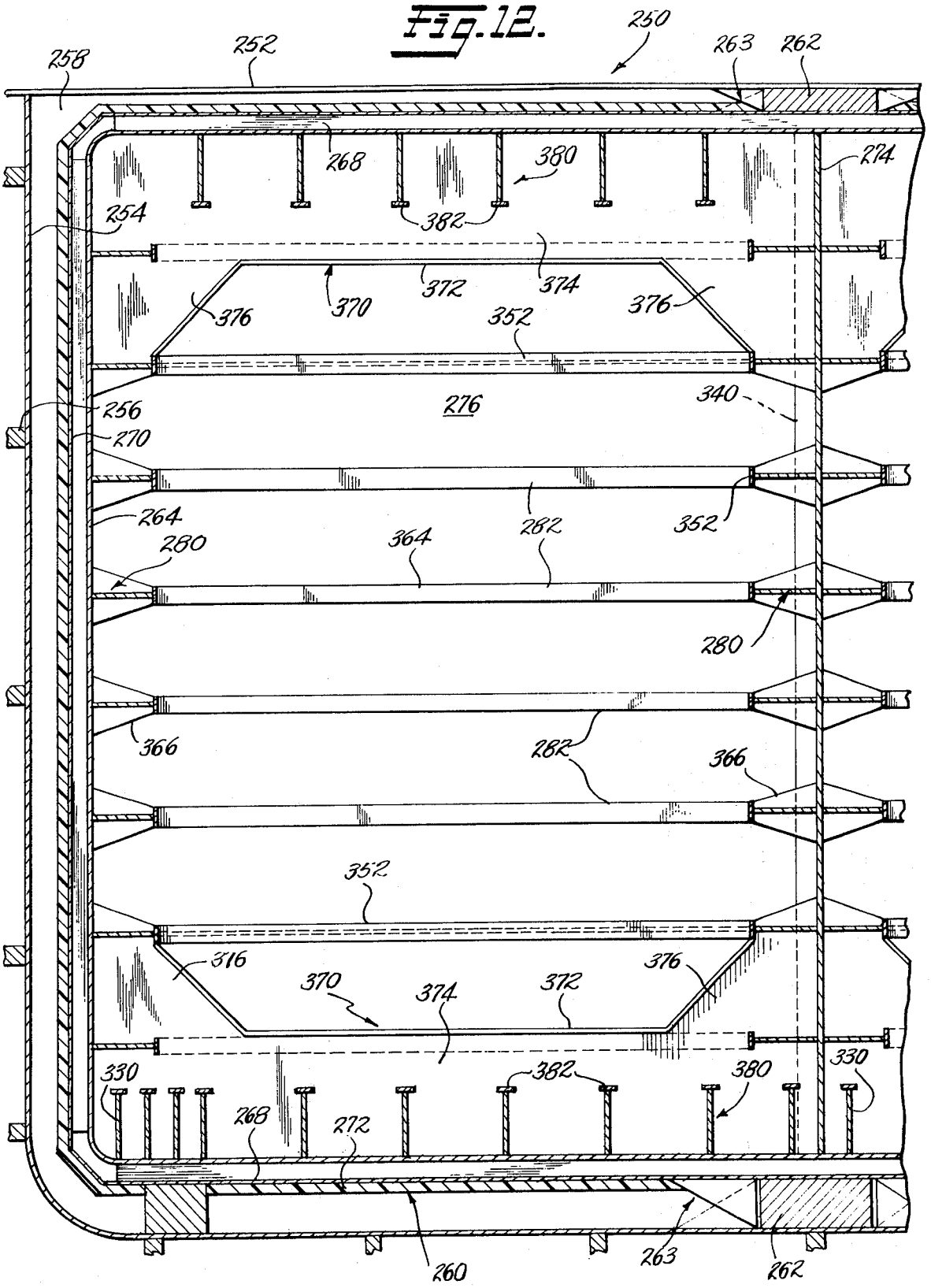
FIG. 12 is an enlarged view of the port side of the cargo tank of FIG. 11.

Cargo tank 260 is divided longitudinally by centerline longitudinal bulkhead 274. Longitudinal bulkhead 274 divides cargo area 266 into port and starboard cargo areas 276 and 278 respectively. A plurality of horizontal webs 280 are seen in FIG. 11. The longitudinal axis of stiffeners 268 which are adjacent to horizontal webs 280 are perpendicular to the plane of horizontal webs 280. As seen in FIG. 12, each of horizontal webs 280 has a plurality of transverse tension trusses 282 which help to transfer loads normally carried by the outboard sides of cargo tank 260 to centerline longitudinal bulkhead 274. A plurality of stiffeners 340 are attached to one side of the centerline longitudinal bulkhead 274. These stiffeners pass through horizontal webs 280 and serve to stiffen centerline longitudinal bulkhead 274 in conventional manner.

Horizontal webs 280 are welded to centerline longitudinal bulkhead 274 and to the inner surface of inner tank 264. Horizontal webs 280 have cutout portions 350 which form web rings 358. Each of horizontal webs 280 has a stiffening face plate 352 which extends around the inner periphery of web rings 358. A plurality of transverse tension trusses 282 extend across cutout portion 350 of each web 280 and connect inner horizontal side portion 354 to outer horizontal side portion 356 of each web ring 358. Transverse tension trusses 282 comprise I-beams having web portion 360 and fore and aft flange portion 362 and 364, respectively. The ends of transverse tension trusses 282 are welded to the inner face of face plates 352 of webs 280. Trapezoidal-shaped brackets 366 are welded to primary barrier 264, web rings 358, and the outer faces of face plates 352 on both sides of web 280 in the same vertical plane as each flange portion 362 and 364 of transverse tension trusses 282. Transverse tension trusses 282 serve to transfer part of the load normally carrier by the side walls of cargo tank 260 to centerline longitudinal bulkhead 274. Furthermore, the use of tension trusses 282 allows a reduction to be made in the scantling of horizontal webs 280.

Figure 13:
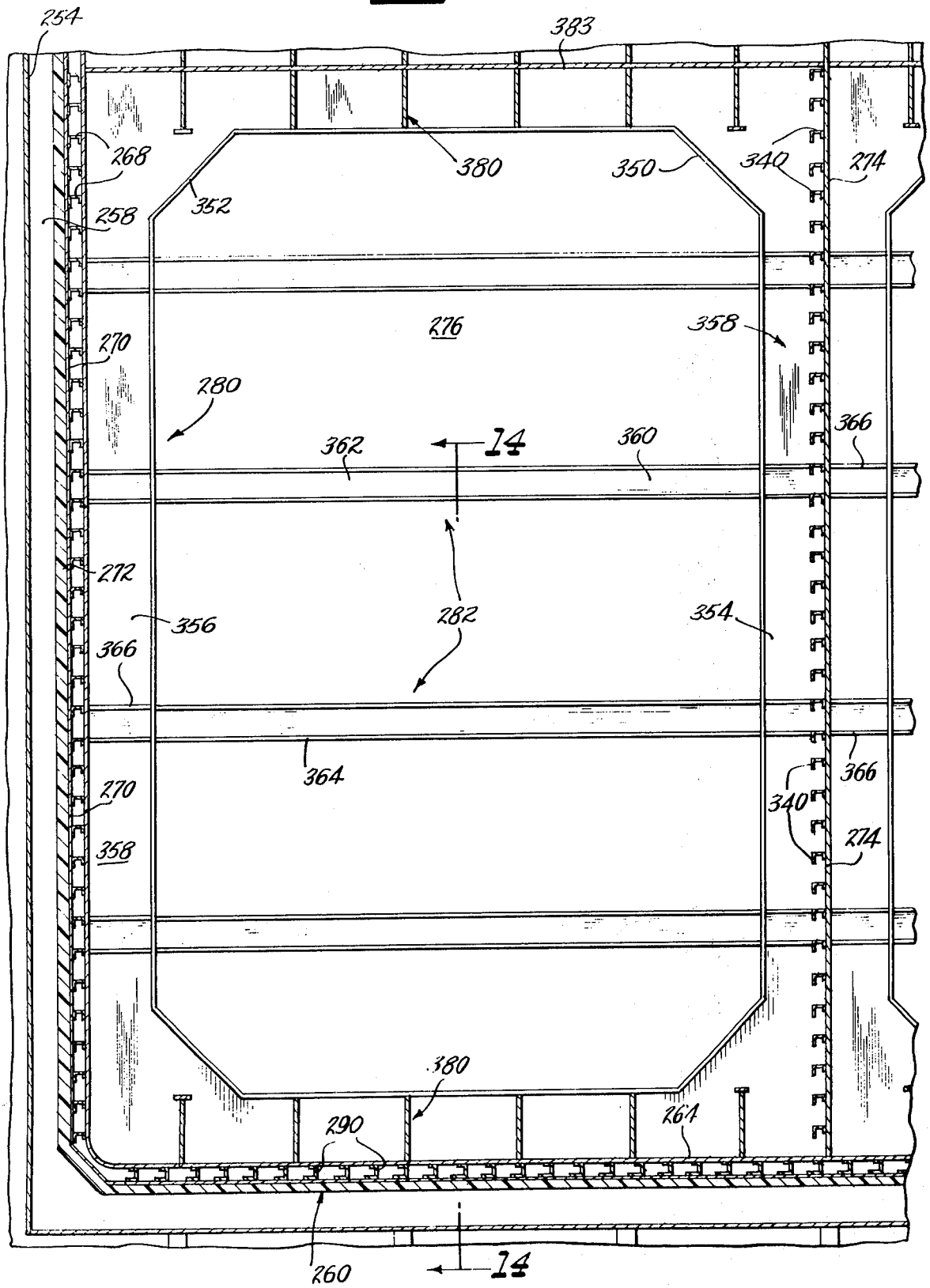
FIG. 13 is a horizontal cross-section taken along lines 13—13 of FIG. 12.
Figure 14:
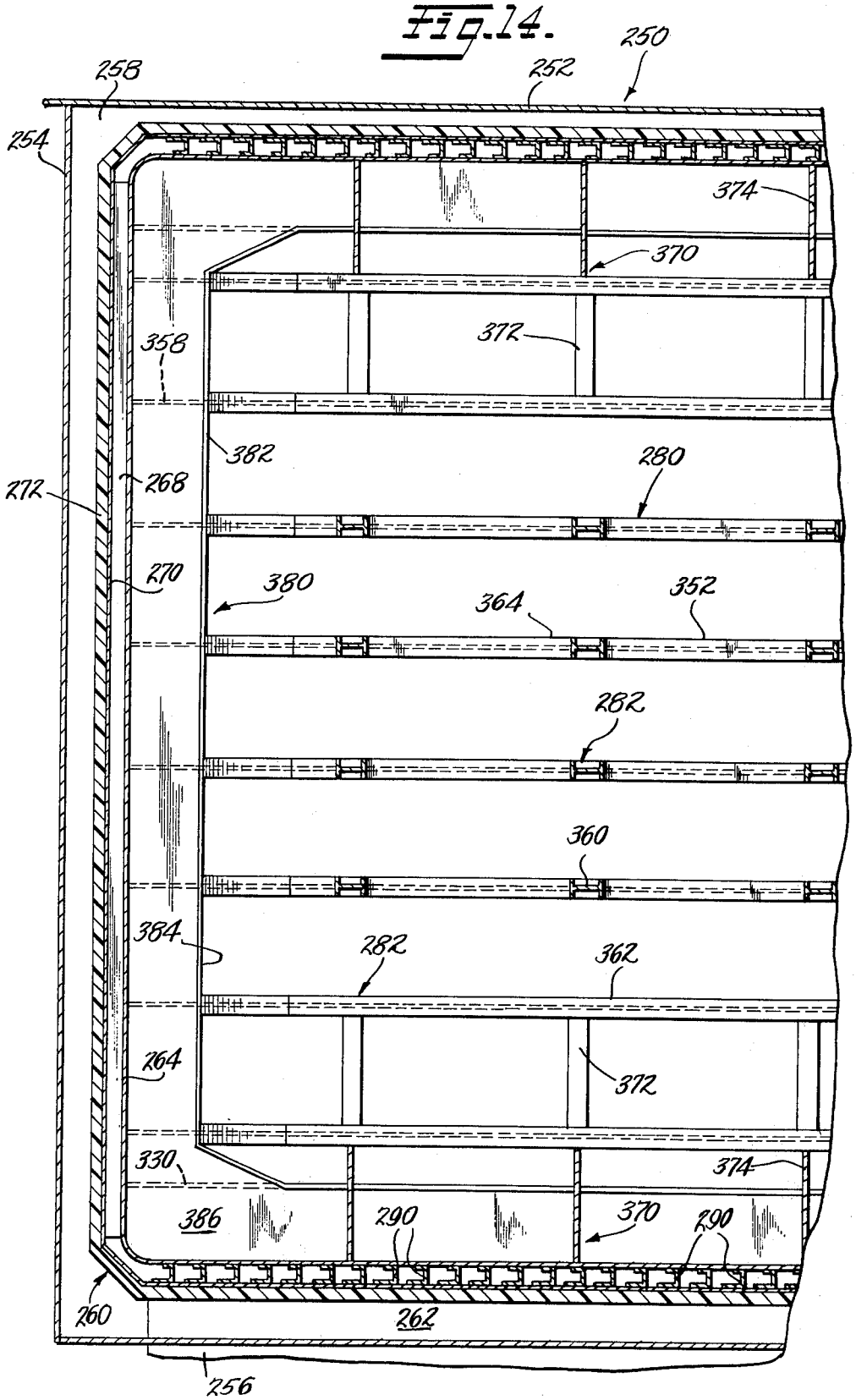
FIG. 14 is a vertical cross-section taken along lines 14—14 of FIG. 13.

Referring now to FIGS. 12, 13 and 14 cargo tank 260 also includes a plurality of vertical webs 380 having stiffening face plates 382 extending around the inner periphery thereof and which form a part of the primary structural support web system. Vertical webs 380 run longitudinally in cargo tank 260 and are welded to the inner surface of inner tank 264, and to centerline transverse bulkhead 383 at the longitudinal center of cargo tank 260. Vertical webs 380 pass through vertical webs 370 along the top and bottom of cargo tank 260 and through horizontal webs 280 along the ends of cargo tank 260 and adjacent to centerline transverse bulkhead 383. Vertical webs 380 have cutout portions 384 which form web rings 386.

A plurality of vertical webs 370 having stiffening face plates 372 around the inner periphery thereof form a part of the secondary structural support web system (see FIGS. 12 and 14). Vertical webs 370 are placed in the same vertical planes as tension trusses 282. There are two vertical webs 370 in each vertical plane of tension trusses 282. One of these vertical webs 370 is positioned along the top of inner tank 264 and the other is positioned along the bottom. Vertical webs 370 are welded to centerline longitudinal bulkhead 274 and the inner surface of primary barrier 264. As can be seen in the figures, the top and bottom horizontal webs 280 do not have transverse trusses 282, but rather pass through vertical webs 370. Vertical webs 370 are generally C-shaped and have main body portion 374 and leg portion 376 which are each welded at their ends to one of horizontal webs 280.

Referring now to FIGS. 15–17, the configuration and construction of a typical insulation panel 120 is seen, as well as the association of a plurality of insulation panels 120 to form insulation layer 72. While the insulation panels will be described with reference to the first embodiment of the present invention, it will be understood that these panels are also used with the second embodiment. Insulation panels generally comprise outer shell 396 filled with insulation material 398 such as polyurethane. More specifically, insulation panels 120 comprise main body portion 400 defined by upper face plate 402, lower face plate 404 and side members 406. Upper face plate 402 and lower face plate 404 are typically formed from flat sheets of plywood, one of which is adapted to lie flush with the outer surface of secondary barrier 70 of double wall tank 60. Insulation panels 120 are generally rectangular in shape and typically have a width of about 2 feet and a length of about 8 feet. Side members 406 are conveniently formed from 2 × 8's.

Insulation panels 120 further comprise upper and lower L-shaped ledges 408 and 410, respectively. Upper ledge 408 extends around the upper outer periphery of two sides of main body portion 400, and lower ledge 410 extends around the bottom outer periphery of the opposite two sides of main body portion 400. Upper ledge 408 includes end portion 412 extending along one end of insulation panel 120 and side portion 414 extending along one side of insulation panel 120. In like manner, lower ledge 410 includes end portion 416 extending along the other end of insulation panel 120 and side portion 120 extending along the other side. The thickness of each of the ledges 408 and 410 is less than the thickness of main body portion 400. The sides 420 of upper ledge 408 and 42 of lower ledge 410 are conviently formed from 2 × 4's. The top of upper ledge 408 is covered by upper face plate 402 and in like manner the bottom of ledge 410 is covered by lower face plate 404. The bottom of upper ledge 408 and the top of lower ledge 410 can be covered by L-shaped sheets of plywood.

Side portion 414 of upper ledge 408 is adapted to overlap side portion 418 of lower ledge 410 of an adjacent insulation panel 120 as shown in FIG. 17. In like manner, end portion 412 of upper ledge portion 420 is adapted to overlap end portion 416 of lower ledge 410, also as shown in FIG. 17. Stud bolts 112 of attachment means 110 extend through the lap joints 122 formed by side portions 414 and 418 of upper and lower ledges 408 and 410, respectively, as shown in FIGS. 6 and 7. End portions 412 and 416 of upper and lower ledges 408 and 410, respectively, are held together by wood screws 424 or other conventional means. Any openings left after the insulation panels 120 are assembled on the outside of secondary barrier 70 are filled with foam insulation 426 which is also applied to the outside surface of attachment means 110 (FIG. 7) and wood screws 424 (FIG. 17) to avoid heat leakage.

It should be appreciated that while several embodiments of the present invention have been described, these embodiments are described for the purpose of illustration only and are not intended to limit in any way the scope of the present invention. It is the intent, therefore, that the present invention not be limited by these specific embodiments, but only be limited as defined in the appended claims.

What is claimed is:

1. A double wall tank for the transportation of cryogenic materials by ship, the tank comprising: a liquid and gas-impervious primary barrier defining a cargo space, said primary barrier being substantially planar; a plurality of primary webs rigidly connected to the inner surface of said primary barrier and extending into said cargo space in a plane substantially perpendicular to the plane of said primary barrier; a plurality of stiffeners rigidly connected to the outer surface of said primary barrier and extending substantially perpendicular to the plane of said primary webs, each of said stiffeners comprising a web portion lying in a plane substantially perpendicular to the plane of said primary barrier, a primary flange portion attached to said web portion, lying in a plane substantially parallel to the plane of said primary barrier and rigidly connected to the outer surface of said primary barrier, and a secondary flange portion spaced from said primary barrier, connected to said web portion of said stiffener and lying in a plane substantially parallel to the plane of said primary barrier; a secondary barrier spaced from and surrounding said primary barrier and attached to said secondary flange portion of said stiffener in a liquid and gas-impervious manner, said secondary barrier being substantially planar and non-self-supporting, said secondary barrier comprising a plurality of thin metal sheets attached at their sides to the secondary flange portion of said stiffeners; insulation means located outside of said secondary barrier for thermally insulating said tank, said insulation means comprising a plurality of thermal insulation panels supported by said stiffeners and providing a backing and support for said thin sheets of metal comprising said liquid and gas-impervious secondary barrier; means for attaching each thermal insulation panel to a pair of adjacent stiffeners in a substantially liquid and gas-impervious manner; and means for attaching adjacent thermal insulation panels to each other in an overlapping and substantially liquid and gas-impervious manner.

2. The tank of claim 1 in which said stiffeners are channel shaped when viewed in cross-section.

3. The tank of claim 1 in which said stiffeners are bulb angles.

4. The tank of claim 1 in which said stiffeners are I-beams.

5. The tank of claim 1 in which the sides of said thin sheets of metal comprising said liquid and gas-impervious secondary barrier are attached to said secondary flange portion of said stiffeners in a spaced-apart manner such that said secondary flange portion forms part of said secondary barrier.

6. The tank of claim 1 in which each thermal insulation panel comprises a main body portion and first and second L-shaped edge portions, said first L-shaped edge portion being attached to the top outer periphery of two sides of said main body portion and said second L-shaped edge portion being attached to the bottom outer periphery of the opposite two sides of said main body portion such that the edge portions are adapted to form lap joints with edge portions of adjacent thermal insulation panels and thereby form a substantially liquid and gas-impervious insulation barrier.

7. The tank of claim 1 in which said insulation means comprises a plurality of thermal insulation panels attached to the secondary flange portion of said stiffeners and having their inner face flush with the outer face of said secondary barrier so as to provide a backing and support for said secondary barrier.

8. The tank of claim 1 in which each of said thermal insulation panels is attached to a pair of adjacent stiffeners at their sides and to adjacent thermal insulation panels at their ends.

9. The tank of claim 1 in which said thin sheets have a thickness of about 0.02 inch.

10. A double wall tank for the transportation of cryogenic materials by ship, the tank comprising: a liquid and gas-impervious inner tank defining a cargo space, said inner tank being prismatic in shape and constituting a primary barrier; a longitudinal bulkhead inside said inner tank and dividing said inner tank into port and starboard cargo areas; a plurality of web rings extending between said longitudinal bulkhead and the sides of said inner tank and rigidly connected thereto; a plurality of tension trusses extending transversely of said inner tank and connecting opposite sides of each of said web rings, the tension trusses connected to respective web rings lying in the same plane as said respective web rings; a plurality of stiffeners rigidly connected to the outer surface of said inner tank and extending substantially perpendicular to the plane of said web rings on the sides of said inner tank where said web rings are ridigly connected; a liquid and gas-impervious outer tank spaced from said inner tank and supported by said stiffeners, said outer tank being non-self-supporting and constituting a secondary barrier; and insulation means located outside of said outer tank for thermally insulating said double wall tank.

11. The tank of claim 10 in which said web rings have stiffening face plates around the inner periphery thereof and in which said tension trusses comprise I-beams attached at their ends to the face plates of said web rings.

12. The tank of claim 10 and further comprising a transverse bulkhead inside said inner tank and dividing each of said port and starboard cargo areas into fore and aft cargo areas.

13. The tank of claim 12 and further comprising a plurality of vertical webs extending out from said transverse bulkhead and the longitudinal ends of said tank and partially into said cargo space.

14. The tank of claim 13 wherein said vertical webs are rigidly attached to said web rings.

15. The tank of claim 12 in which said web rings are substantially vertical and extend transversely in said tank.

16. The tank of claim 15 and further comprising a plurality of vertical webs extending out from the transverse bulkhead and the longitudinal ends of said tank and partially into said cargo space.

17. The tank of claim 16 and further comprising a plurality of horizontal webs extending out from the transverse bulkhead and the longitudinal ends of said tank and partially into said cargo space and being positioned in the same horizontal planes as said tension trusses.

18. The tank of claim 12 in which said web rings are horizontal.

19. The tank of claim 18 and further comprising a plurality of vertical web rings extending betweeen said transverse bulkhead and the ends of said inner tank and rigidly connected thereto.

20. The tank of claim 19 and further comprising a plurality of vertical webs extending down from the top of said tank and up from the bottom of said tank and partially into said cargo space and lying in the same vertical planes as said tension trusses.

* * * * *